United States Patent [19]

Crum

[11] Patent Number: 4,515,407

[45] Date of Patent: May 7, 1985

[54] LATCH FOR A CHAIR'S FOOTREST ASSEMBLY

[75] Inventor: Michael A. Crum, LaGrange, Ky.

[73] Assignee: Leggett & Platt, Incorporated, Carthage, Mo.

[21] Appl. No.: 400,982

[22] Filed: Jul. 22, 1982

[51] Int. Cl.[3] ..... A47C 7/50; A47C 1/02

[52] U.S. Cl. ..... 297/429; 297/68; 297/DIG. 7

[58] Field of Search ..... 248/410; 297/DIG. 7, 297/429, 269, 271, 68, 88, 89, 83, 85; 188/77 W

[56] References Cited

U.S. PATENT DOCUMENTS

| | | | |
|---|---|---|---|
| 545,492 | 9/1895 | Hall | 188/77 W |
| 2,387,711 | 10/1945 | Barr | 188/77 W |
| 2,834,397 | 5/1958 | Kluglein et al. | 297/68 |
| 2,918,964 | 12/1959 | Braun | 297/434 |
| 3,131,965 | 5/1964 | Mohler | 297/DIG. 7 |
| 3,162,483 | 12/1964 | Fletcher | 297/85 |
| 3,295,885 | 1/1967 | Barksdale | 297/84 |
| 4,092,041 | 5/1978 | Landry et al. | 297/68 |
| 4,113,311 | 9/1978 | Reida | 297/433 |
| 4,212,494 | 7/1980 | Dabney | 297/DIG. 7 |
| 4,226,468 | 10/1980 | Johnson | 297/84 |
| 4,365,836 | 12/1982 | Jackson et al. | 297/68 X |
| 4,408,796 | 10/1983 | Mizelle | 297/85 |
| 4,411,339 | 10/1983 | Porter | 188/77 W |

*Primary Examiner*—James T. McCall
*Attorney, Agent, or Firm*—Wood, Herron & Evans

[57] ABSTRACT

A novel friction latch connected with a chair's footrest mechanism, the footrest mechanism operating to open and close the chair's footrest. The friction latch cooperates with the footrest mechanism to hold the footrest in any desired location between the full extend and full retract positions. The friction latch, in preferred form, includes a torsion spring concentrically and coaxially positioned with a drum that is connected to the footrest mechanism. In the extend mode, the torsion spring is released from a tight friction fit with the drum so the footrest can be opened by a spring motor that extends the footrest assembly. In the latch mode, the torsion spring grips the drum in sufficiently tight friction fit to prevent the footrest from moving when no force is exerted on it, as well as from being retracted in response to the leg weight of the chair's occupant when that occupant is seated comfortably in the chair with his feet on the footrest. In the retract mode, the torsion spring and drum may be the same as in the latch mode, but when an occupant is in the chair the footrest can be closed in response to drawing up of the occupant's legs, i.e., the friction fit of the torsion spring and drum can be overcome by the chair's occupant simply using his legs to exert a closing force against the footrest.

22 Claims, 11 Drawing Figures

LATCH FOR A CHAIR'S FOOTREST ASSEMBLY

This invention relates to chairs. More particularly, this invention relates to an improved footrest assembly for a chair.

Chairs with movable footrests have been known for years in the marketplace and in the patent art. Commonly, such chairs include a chair frame to which the footrest assembly is connected. The footrest itself is usually comprised of a cushioned panel that is movable by a footrest mechanism from a retracted or closed position that is located beneath the chair's seat to an extended or opened position that is located forwardly of the chair. When the footrest is fully extended, the chair's user leans back in the chair and rests his legs/feet on the footrest in a position generally horizontal to floor. Footrests that are extendable and retractable are often used on action chairs. An action chair is generally referred to in the trade as any chair that is other than a stationary chair. Typical action chairs include recliner chairs, rocking chairs, swivel chairs and combinations of these basic chair types, e.g., rocker-recliner chairs, rocker-swivel chairs, and the like.

For chairs having extendable/retractable footrests, it is necessary that the footrest mechanism be provided with some kind of a latch by which the cushioned footrest is restrained or locked in an extended position. This is necessary, of course, because the weight of the chair occupant's legs would cause the footrest to retract toward the chair unless the footrest was latched or locked in the extended position when the chair's occupant sits in the chair and places his legs/feet on top the outwardly extended footrest. Accordingly, various latch structures are known by which extendable/retractable footrests can be retained in the extended position. And it is also desirable in the marketplace to provide a latch for a chair's footrest by which the footrest can be latched or locked in its retracted or storage position beneath the chair's seat when it is not extended from the chair. This latter latch feature is necessary because it will be often desired to sit in the chair without the footrest extended at all, and during such usage, as well as when no one is using the chair, it is important aesthetically to keep the footrest in the fully retracted or storage position.

But there are a couple of basic problems associated with footrest latch structures for chairs as are known to the prior art. A first problem is that the known latch structures generally provide a latch function at the full retract position as well as at the full extend position, and perhaps at one or two intermediate extend positions. But generally known latch structures do not enable a chair's footrest to be latched in position at an infinite variety of positions between the full retract and full extend positions. Quite obviously, what may be deemed a comfortable position by one user may be deemed uncomfortable by another user. In other words, the prior art latch structures for extendable/retractable footrests of which I am aware do not permit a final use position for the footrest to be established solely in response to the user's desires, i.e., prior art latch structures establish a limited number of pre-set extend positions dependent solely on the latch structures. A second problem associated with prior art latch structures for extendable/retractable footrests occurs when the footrest is in the full retract position. One or more components of each known prior art latch structure tends to wear after a period of use. And wear of the latch structure's components often results in the footrest not being latched firmly in the full retract position. In other words, the footrest tends to droop or drift toward the full extend position out of its full retract position or storage position after a period of use due to wear of the latch structure's components. This is considered undesirable from an aesthetic standpoint.

Accordingly, it has been one objective of this invention to provide an improved latch for an extendable/retractable footrest assembly of a chair, the latch functioning to retain by friction the footrest in the full extend position, and the full retract position, as well as in any position therebetween as desired by the chair's occupant.

It has been another objective of this invention to provide an improved latch for a chair's extendable/retractable footrest assembly, the footrest being normally spring biased toward the full extend position, the latch functioning to establish a friction fit between two components which is sufficient to restrain the footrest in any storage position desired when the chair is not occupied, and which is sufficient to restrain the footrest in that extend position desired by the chair's occupant when seated in the chair with his legs resting comfortably on the footrest, but which is not sufficient to prevent the chair's occupant from drawing the footrest back toward the full retract position through use of the occupant's legs while seated in the chair when closing of the footrest is desired.

It has been still another objective of this invention to provide an improved latch for a chair's extendable/retractable footrest, the latch comprising a torsion spring that grips a drum in friction fit relation so that release of the torsion spring from latched friction fit with the drum permits that footrest to open from a full retract position, and so that the friction fit of the torsion spring against the drum is sufficient to latch the footrest in any desired open position at which the weight of a chair occupant's legs can be supported thereon, but is not sufficient to prevent closing of the footrest simply by exerting a retract force on the footrest by use of the chair occupant's legs.

In accord with these objectives, this invention is directed to a novel friction latch connected with a chair's footrest mechanism, that footrest mechanism operating to open and close the chair's footrest. The friction latch cooperates with the footrest mechanism to hold the footrest in any desired location between the full extend and full retract positions. The friction latch, in preferred form, includes a torsion spring concentrically and coaxially positioned with a drum that is connected to the footrest mechanism. In the extend mode, the torsion spring is released from a tight friction fit with the drum so the footrest can be opened by a spring motor that extends the footrest assembly. In the latch mode, the torsion spring grips the drum in sufficiently tight friction fit to prevent the footrest from moving when no force is exerted on it, as well as from being retracted in response to the leg weight of the chair's occupant when that occupant is seated comfortably in the chair with his feet on the footrest. In the retract mode, the torsion spring and drum may be the same as in the latch mode, but when an occupant is in the chair the footrest can be closed in response to drawing up of the occupant's legs, i.e., the friction fit of the torsion spring and drum can be overcome by the chair's occupant simply by using his legs to exert a closing force against the footrest.

This novel friction latch for a chair's footrest assembly provides a number of advantages relative to extendable/retractable footrest latch structures known to the prior chair art. The friction latch of this invention allows a chair's occupant to place the footrest in that one extended position most comfortable to him/her while seated in the chair, that position not being predetermined or limited in any way by the latch structure itself. In this regard, the friction latch of this invention allows the chair's occupant to fully extend the footrest automatically while seated in the chair simply by releasing the friction latch in light of the footrest mechanism's spring motor, but allows the chair's occupant to then partially return the footrest back toward the chair to that one final position most comfortable to the user while still seated in the chair simply by positioning the feet on the footrest and then drawing the footrest back toward the chair through use of the leg muscles. In other words, the chair's occupant may easily adjust the footrest from any extended position toward a further retracted position if the footrest is initially overextended beyond the most comfortable position for the chair's user, and this can be accomplished without the chair's occupant being required to fully retract the footrest and start over. The friction latch also allows the chair's occupant to close or fully retract the footrest from any extended or open position to the fully closed position also by retracting the footrest through use of the occupant's leg muscles. This advantage is particularly useful where the chair's occupant may wish to rest his legs periodically during the closing cycle as it allows the leg rest to be retracted in whatever stages or steps of a closing cycle may be desired by the chair's occupant. The friction latch of this invention also eliminates the aesthetically undesirable droop problem that may occur after prolonged use of prior art latches for extendable/-retractable footrests. The friction latch of this invention holds, in positive fashion and regardless of the structure of the extend/retract mechanism, the footrest in whatever position is desired by the chair's occupant, including the fully retracted and fully closed positions. In other words, and regardless of the wear between the spring and drum that may occur over time, the spring always tightens into a tight friction fit relation against the drum when the latch is in the latch position so that wear of the footrest extend/retract mechanism and/or of the latch itself does not adversely effect the positive latch effect. The friction latch also can be easily released so that the footrest mechanism's spring motor can extend automatically the footrest from any retract position toward any extend position regardless of the size or weight of the chair's occupant. It is, of course, quite desirable that neither the size nor weight of the chair's occupant adversely effect the operation function of the friction latch either when extending the footrest or when retracting the footrest. Further, the footrest is spring motor driven during its movement from full retract or storage position toward the full extend position, the spring motor being activated by a control handle that is manually operated. The friction latch can be latched at any point during the spring driven opening cycle simply by use of the latch's handle. However, the footrest is free to cycle, except as limited by the friction latch, during its retraction from full extend toward full retract positions without need for use of the latch's handle. This feature of the friction latch, in combination with the footrest mechanism's spring motor, provides the infinite footrest position advantages discussed above. One additional advantage of the friction latch is that the chair's occupant can get out of the chair without fear that the footrest mechanism's spring motor will prematurely extend the footrest so as to hit the chair occupant's legs as the occupant arises. This, of course, is because the friction latch provides a positive latch on the footrest mechanism at any and all positions of the footrest between the full extend and full retract positions, and whether or not the footrest is fully retracted when adjacent the closed or storage position.

Other objectives and advantages of this invention will be more apparent from the following detailed description taken in conjunction with the drawings in which:

FIG. 1 is a diagrammatic view of the structural frame and linkage for a rocker/recliner, partially broken away;

FIGS. *2a, 2b,* and *2c* are sequential diagrammatical cycle views of the linkage for a chair in (a) chair position, (b) intermediate position, and (c) full recline position;

GENERAL BACKGROUND

Figure 1:
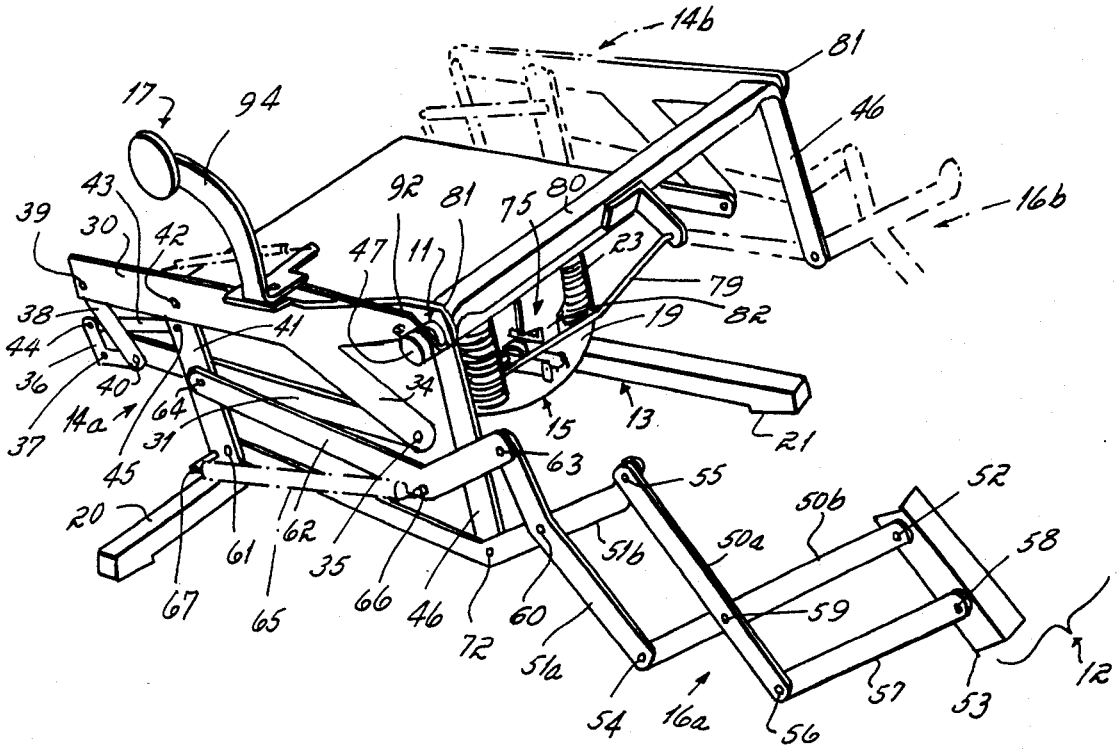

A chair 10 of the action type that incorporates a friction latch 11 for the chair's footrest assembly 12, in accordance with the principles of this invention, is illustrated in the figures. The action type chair 10 is a rocker-recliner chair in which the chair's seat frame (not shown) is connected with the chair's stationary base 13 through a recliner linkage 14 and a swivel-type rocker box 15 assembly. The footrest assembly 12 is connected to the chair 10 through the recliner linkage 14. The footrest assembly 12 includes a padded footrest 9 and a footrest mechanism 16 operable to open and close the footrest. The friction latch 11 is interconnected with the footrest mechanism 16, and is operable by the chair's occupant through use of manual control handle 17. Identical recliner linkages 14A, 14B and footrest mechanisms 16A, 16B, as shown in FIG. 1, are provided on each side of the chair. The friction latch 11 for the chair's footrest assembly 12 operates in a manner explained in greater detail below.

More particularly, the chair's stationary base 13 includes legs 20 that terminate in feet 21, thereby allowing the chair 10 to rest on ground 22. The chair's legs 20 are connected to the rocker box 15, and are mounted to the underside of the rocker box's swivel plate 19. Rocker springs 23 are connected between the top side of the rocker box's swivel plate 19 and a rocker plate 24 connected to the swivel plate by ears 25, thereby allowing the rocker plate to pivot on axis 26 relative to ground as limited by the rocker springs, see FIGS. 2 and 3. A rocker box 15 useful in the recliner-rocker chair 10 is more particularly illustrated in U.S. Pat. No. 4,025,020, assigned to the assignee of this application, the disclosure of which is incorporated herein by reference.

Figure 2C:
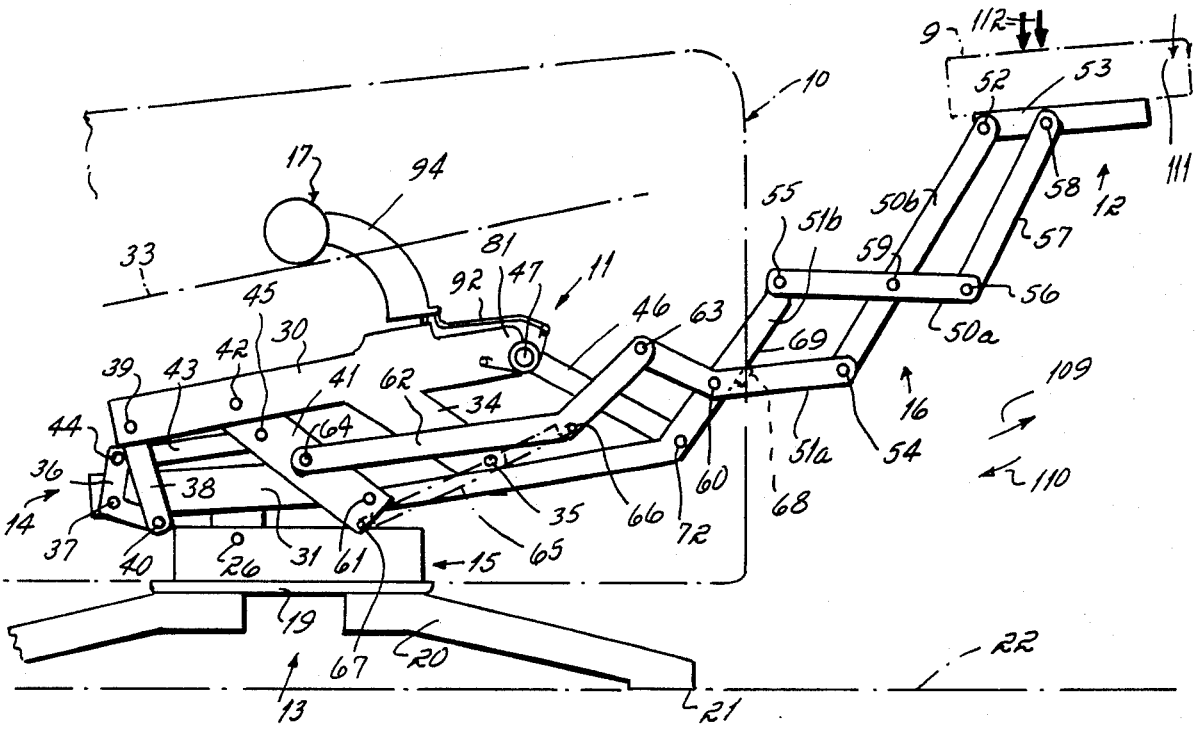
Figure 2A:
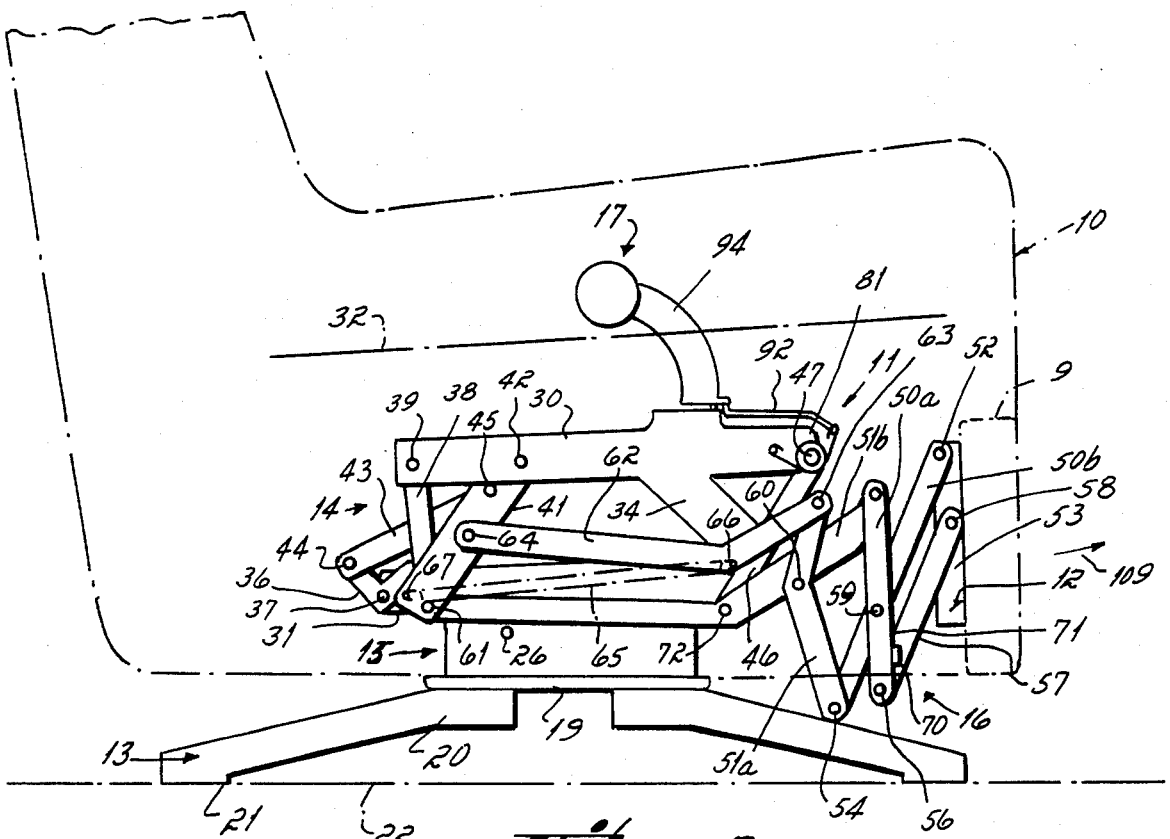

The recliner linkage 14, as shown in FIGS. 1 and 2, includes seat base rail 30 to which the chair's seat frame (not shown) is attached, and rocker base rail 31 which is integral with the rocker box's rocker plate 24. The recliner linkage 14 permits the chair's seat frame (not shown), and therefore, the chair's seat, to be moved between a first or non-reclining stationary position relative to ground as shown by phantom line 32 in FIG. 2*a*, and a second or reclining stationary position angled relative to ground as shown by phantom line 33 in FIG. 2*c*. The recliner linkage 14 includes a seat base leg 34 immobily fixed to the seat base rail 30, the seat base leg being pivotally connected as at 35 to the rocker base rail 31 adjacent the front end thereof. The recliner linkage 14 also includes a dogleg link 36 pivotally connected as at 37 on that link's elbow to the rocker base rail 31 adjacent the rear end thereof. A rear recliner link 38 is pivotally connected at one end as at 39 to the rear end of the seat base rail 30, and pivotally connected at the other end as at 40 to one end of the dogleg link 36. An intermediate recliner link 41 is pivotally connected at one end as at 42 to the seat base rail 30 intermediate the ends thereof, and a recliner control link 43 is pivotally connected as at 44 to the other end of the dogleg link 36 and is pivotally connected as at 45 in between the ends of the intermediate recliner link 41. Footrest control link 46 is pivotally connected at one end as at 47 to the front end of the seat base rail 30. It is through the intermediate recliner link 41 and the footrest control link 46 that the footrest mechanism or linkage 16, and thereby, the footrest 9, is connected with the chair's recliner linkage 14. The reclined position (FIG. 2*c*) of the recliner linkage 14, and therefor of the chair 10, is established only when the footrest assembly 12 is fully extended as shown in FIG. 2*c*. The non-reclined position (FIG. 2*c*) of the recliner linkage 14, and therefor of the chair 10, is established when the footrest assembly 12 is in the full retracted position as shown in FIG. 2*a*.

The chair's footrest mechanism or linkage 16 includes an outer scissors link pair 50*a*, 50*b* and an inner scissors link pair 51*a*, 51*b*. The outer end of outer scissors link 50*b* is pivotally connected as at 52 to footrest support plate 53, and the inner end of that link 50*b* is pivotally connected as at 54 to outer end of inner scissors link 51*a*. The other outer scissors link 50*a* is pivotally connected at its inner end as at 55 to the outer end of inner scissors link 51*b*, and is pivotally connected at its outer end as at 56 to the inner end of outer connector link 57. The outer end of the outer connector link 57 is pivotally connected as at 58 to the footrest plate 53. The two outer scissors links 50*a*, 50*b* are pivotally connected one to the other as at 59 intermediate the ends thereof. The inner scissors links 51*a*, 51*b* are also pivotally connected intermediate the ends thereof as at 60. The inner end of inner scissors link 51*b* is pivotally connected as at 61 to the free end of intermediate recliner link 41. Inner connector link 62 is pivotally connected at its outer end as at 63 to the inner end of inner scissors link 51*a*, and is pivotally connected as at 64 to the intermediate recliner link 41 intermediate the ends thereof. Note that a footrest extension motor in the form of tension spring 65 is connected at one end as at 66 to the inner connector link 62 and is connected at the other end as at 67 to the free end of the intermediate recliner link 41. This spring motor 65 is constantly in tension and, therefore, constantly biases the footrest linkage 16 and footrest 9 toward the normally opened position shown in FIG. 2*c*. The full extend position of the footrest linkage 16 is defined when stop pin 68, which is mounted on inner scissors link 51*a*, abuts edge 69 of inner scissors link 51*b*, see FIG. 2*c*. The full retract or storage position of the footrest linkage 16 is defined when stop pin 70, which is mounted on outer connector link 57, abuts edge 71 of outer scissors link 50*a*, see FIG. 2*a*. Note that, as previously mentioned, the footrest control link 46 is pivotally connected at one end as at 47 to the front end of the seat base rail 30, and is pivotally connected at the other end as at 72 intermediate the ends of the inner scissors link 51*b*. The footrest control link 46, in cooperation with friction latch 11, functions to control the extend/retract position of the padded footrest 9 relative to ground 22 upon extension or retraction of the footrest linkage 16 as explained in greater detail below.

The recliner-rocker chair 10 also includes a rocker lock 75 that locks the chair in a non-rocking position, i.e., that prevents rocking of the rocker box's rocker plate 24 (and, therefor, the chair) relative to the chair's base 13, when the footrest linkage 16 is fully extended. This rocker lock 75, which is shown particularly in FIG. 3, includes lock roller 76 pivotally mounted to lock arm 77 at one end, the other end of that lock arm being pivotally mounted as at 78 to the top side of the rocker box's swivel plate 22. The roller 76 end of a lock arm 77 is permanently connected through extended length rod 79 to crossbar 80 pivotably mounted at pivot 47 between the outer ends 81 of the seat base rails 30 of the recliner linkage 14*a*, 14*b*, see FIG. 1. The crossbar 80, therefor, is pivotably fixed relative to the chair's seat frame (not shown) at all times whether the chair is being rocked, is reclined and/or has its footrest 9 extended or retracted. The roller 76 cooperates with a lock plate 82 fixed to the underside of the rocker box's rocker plate 24 and under normal rocking action of a chair, the lock roller 76 simply rests on the plate 22. On the other hand, when the footrest 9 is extended into the fully extended position shown in FIGS. 2*c* and 3 as established by the footrest linkage 16, the arm 77 to which the lock roller 76 is connected forces the roller into a capture position with the lock plate 82 because the crossbar 80 to which control rod 79 is connected is pivoted. This for the reason that as the crossbar 80 is pivoted on pivot 47, the rod 79 attached thereto is pulled forward. The forward movement of rod 79 will rotate arm 77 about its pivot 78 and bring the roller into the lock plate 82 to prevent rocking movement of the rocker plate 24 relative to ground. This, of course, prevents rocker movement of the chair's seat relative to ground when the footrest 9 is fully extended.

The Friction Latch

Figure 2B:
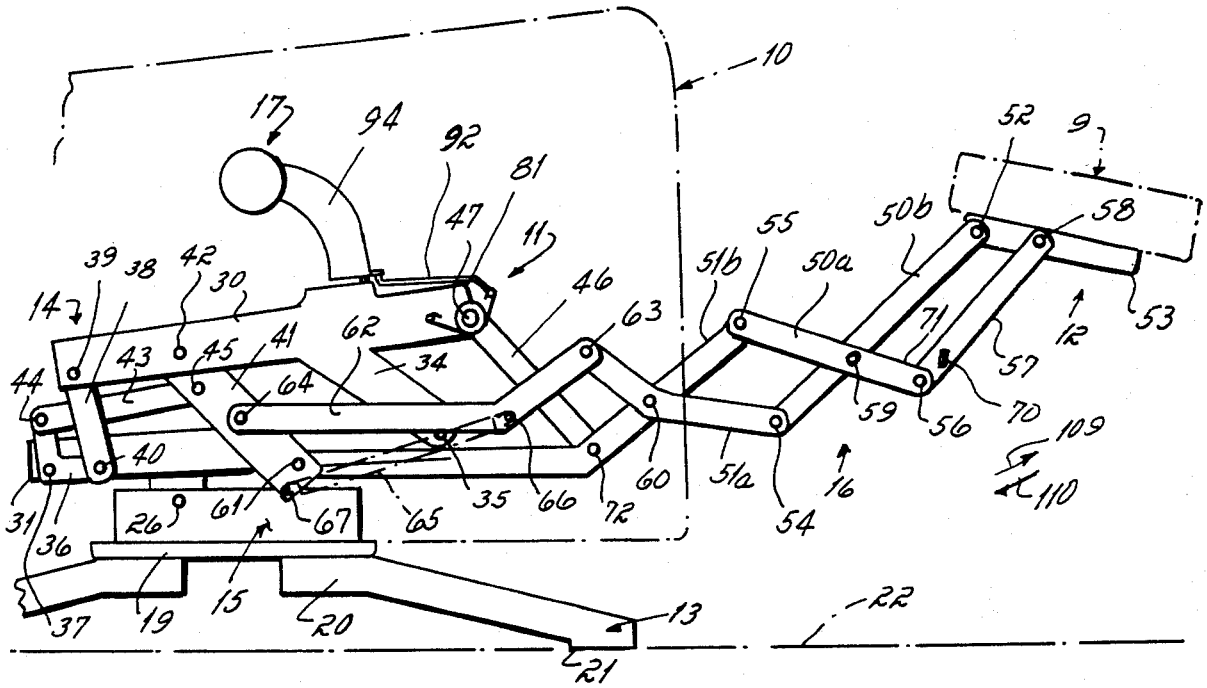
Figure 3:
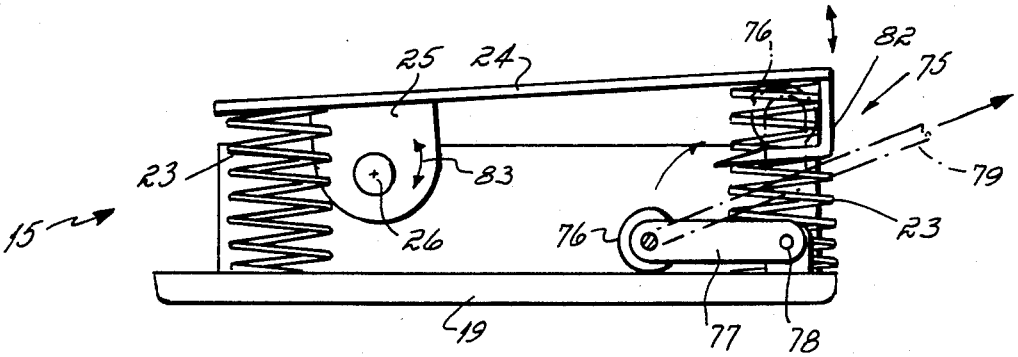
FIG. 3 is a diagrammatic view of the rocker box for the chair.
Figure 4:
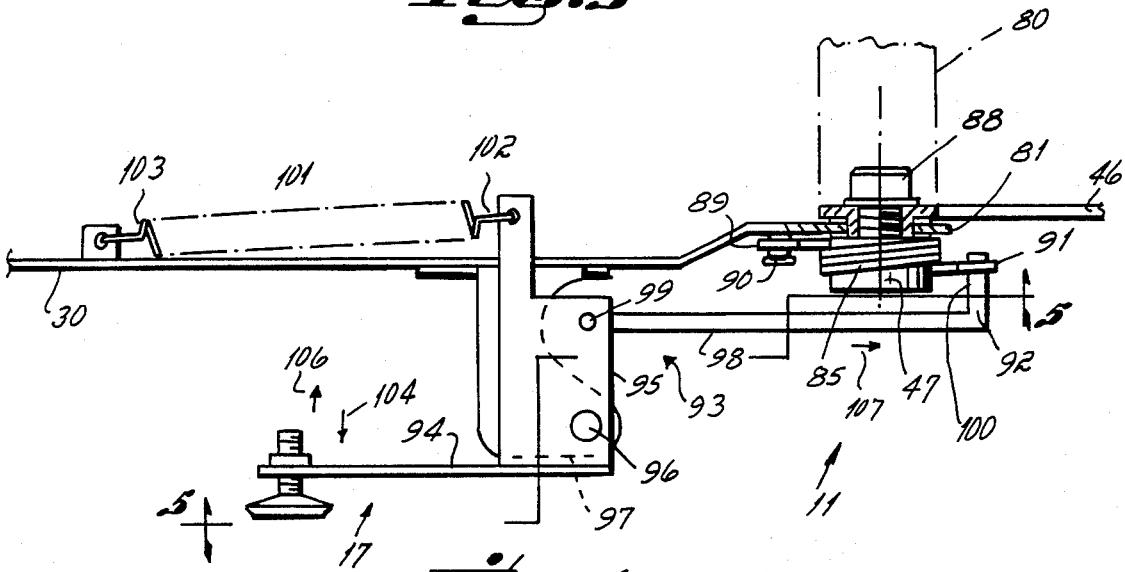
FIG. 4 is a fragmentary top view of the footrest latch mechanism.
Figure 5:
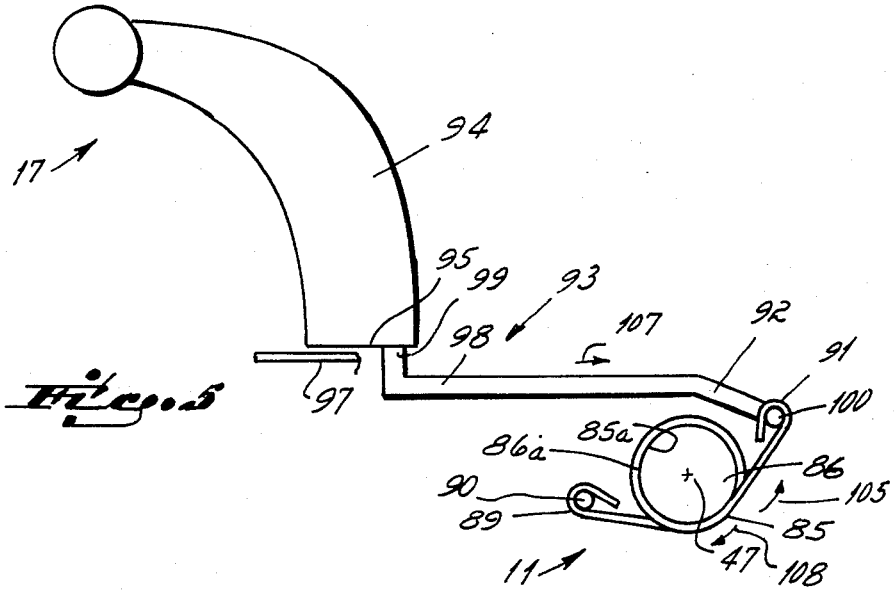
FIG. 5 is a view as seen generally along line 5—5 of FIG. 4.

The friction latch 11, or rather a first embodiment thereof, that cooperates with footrest assembly 16 is shown in FIGS. 1 through 5 and particularly in FIGS. 1, 4 and 5. The friction latch 11 basically includes a helical torsion spring 85 concentrically and coaxially wrapped around a cylindrical drum 86 and a handle 17 by which the spring may be released from the drum as desired. The inner surface 85*a* of the torsion spring 85 presents a first friction surface, and the outer surface 86*a* of the drum 86 presents a second friction surface, these friction surfaces cooperating one with the other when the torsion spring is in spring-tight or friction fit relation with the drum to prevent relative rotation between those two components. The drum 86 is immobily fixed to the footrest control link 46, and is positioned coaxially with that link's pivot axis 47 relative to the recliner linkage's seat base rail 30. The drum 86, the footrest control link 46 and crossbar 80 are all immobily connected together by bolt 88, see FIG. 4. As earlier noted, the crossbar 80 interconnects the two footrest linkages 16*a*, 16*b*. Thus, the crossbar 80, the two footrest control links 46, and the single drum 86, are all permanently and immobily connected one with the other, and this immobily connected drum/crossbar/-footrest control link structure is pivotally connected to the recliner linkages' seat base rails 30 on pivot axis 47.

One end 89 of the friction latch's torsion spring 85 is immobily fixed to the seat base rail 30 by pin 90. The free end 91 of the torsion spring 85 is connected as at 92 through handle linkage 93 to the manual control handle 17. The handle linkage 93 includes a control arm 94 to which the handle 17 is fixed, the control arm including a pivot plate 95. The pivot plate 95 is pivotally connected on vertical pivot axis 96 to ear 97 immobily fixed to the recliner linkage's seat base rail 30 (and, therefor, to the chair's seat). A connector rod 98 is pivotally connected at end 99 to the control arm's pivot plate 95, and is pivotally connected at end 100 to the free end 91 of the torsion spring 85. Handle control spring 101, fixed at one end 102 to the control handle's pivot plate 95 and at the other end 103 to the recliner linkage's seat base rail 30, is in the form of a tension spring that continuously biases the control handle 17 outwardly away from the chair in the direction shown by arrow 104 in FIG. 4. This normal control spring 101 bias cooperates with the normal bias of torsion spring 85 (which normally tends to wrap tightly around the drum 86 as shown by arrow 105) to continuously urge the friction latch 11 to the maximum friction fit or latch position. Alternatively, and when the control handle 17 is manually directed inward toward the chair as shown by arrow 106, such tends to release or unwind the torsion spring 85 from friction fit with the drum 86 because the connector rod 98 is moved in the direction shown by arrow 107 which tends to unwrap the spring from the drum in a direction shown by arrow 108.

Use of the friction latch 11 for the chair's footrest assembly 16 is as illustrated in FIGS. 1–5. Note, as shown in FIG. 2*a*, that the footrest assembly 16 is in the full retracted or storage position. In this storage attitude, the control link 46 is prevented from pivoting relative to its axis 47 of interconnection with the seat base rail 30 because the drum 86 is attached to the footrest linkage's control link 46 and because the friction spring 85 is attached to the seat base rail 30. And this, in turn, prevents the footrest linkage's spring motor 65 from extending the footrest 9. This for the reason that the helical torsion spring 85 is tightly wrapped around the drum 86, to prevent relative motion between the drum and the spring. Also in this regard, it should be noted that the frictional resistance created between the torsion spring 85 and the drum 86 is, of course, quite sufficient to prevent extension of the footrest 9 in response to the footrest linkage's spring motor 65 regardless of whether the footrest is in the storage, intermediate extend or full extend positions (as shown in FIGS. 2*a*, 2*b* and 2*c*, respectively, and with or without an occupant in the chair.

When it is desired to release the friction latch 11, thereby allowing the footrest 9 to extend outwardly, i.e., to open, in the direction of arrow 109 in response to the linkage's spring motor 65, the helical torsion spring 85 need be only slightly unwrapped from friction fit relation with the drum 86 by unwrapping it in the direction shown by arrow 108 in FIG. 5. This is achieved by moving the control handle 17 inwardly toward the chair in the direction shown by arrow 106, the control handle's arm 94 pivoting on vertical axis 96 against the resistance of control spring 101, thereby forcing the control handle's connector rod 98 in the direction shown by arrow 107 which tends to unwrap the torsion spring 85 in the direction 108 from friction fit with the drum 86. When the torsion spring 85 has been slightly unwrapped, the tension of the footrest linkage's spring motor 65 overcomes the friction relation between the torsion spring 85 and the drum 86, and the footrest linkage 16 and footrest 9 are automatically extended toward the full extend position, shown in FIG. 2*c* from the full retract position shown in FIG. 2*a*. If a person is sitting in the chair 10 when the friction latch is released, the footrest 9 will be extended until same comes into abutting relation with the chair occupant's legs or until the handle is released permitting torsion spring 85 to grip drum 86. If no occupant is in the chair, or if the chair occupant's legs are sufficiently upraised, and as long as the control handle 17 is held inward, the footrest linkage's spring motor 65 will extend the footrest until it achieves the full extend position shown in FIG. 2*c*.

Once the desired footrest 9 position is achieved by the chair's user, the control handle 17 is simply released. The handle's control spring 101 will draw same back to the latch position shown in FIG. 4, which in turn allows the torsion spring 85 to rewrap itself in tight friction fit on the drum 86 in the direction shown by arrow 105, thereby latching the footrest 9 in the desired final position. When the footrest 9 is in the desired final position, whether this is an intermediate extend position as shown in FIG. 2*b* or the full extend position as shown in FIG. 2*c*, the friction fit between the torsion spring 85 and the drum 86 is sufficient so as to prevent retraction or closing movement (as shown by arrow 110) of the footrest from its extend position back toward the full retract or storage position, if no one is using the chair, as well as in response to a minor force 111 exerted against the footrest as would be created by the legs of the chair's occupant when those legs are resting on the footrest comfortably while the occupant is sitting in the chair. In other words, a minor return force, as illustrated by arrow 111 in FIGS. 2*b*, 2*c*, generated simply by the legs of the chair's occupant resting on the footrest 9 will not cause the footrest to return toward the storage position shown in FIG. 2*a*. But, the friction latch 11, because it is a latch that functions on frictional resistance between the torsion spring's inner surface 85*a* and the drum's outer surface 86*a*, also functions to permit closing movement of the footrest 9 in direction 110 from any extend position back toward the full retract position in response to a major closing force 112 exerted against the footrest as would be created by the legs of the chair's occupant when those legs are drawn with muscle force against that footrest while the occupant is sitting in the chair. In other words, with an occupant sitting in the chair, and when the occupant desires to close the extended footrest, the chair's occupant need merely use his leg muscles to draw the footrest back toward the chair in direction 110, thereby overcoming the frictional resistance between the torsion spring 85 and the drum 86 which, in turn, causes the chair's footrest 9 to return toward the storage position. Of course, the major closing force 112 employed by the legs of the chair's occupant to the footrest 9 in order to close the footrest against the frictional resistance provided by the friction latch 11 is substantially greater than the minor closing force 111 imparted to the footrest when the legs of the chair's occupant are simply resting on the extended footrest with no leg effort being made to close that footrest.

Other embodiments of the friction latch for the chair's footrest assembly 12 are shown in FIGS. 6–9. The difference between these other embodiments and the first embodiment described above is found solely in the control mechanism by which the torsion spring 85 and drum 86 are released from and re-engaged in frictional latching relation one with the other. In all of these other embodiments, like parts are numbered with like reference numerals relative to those reference numerals used in the first embodiment.

Figure 6:
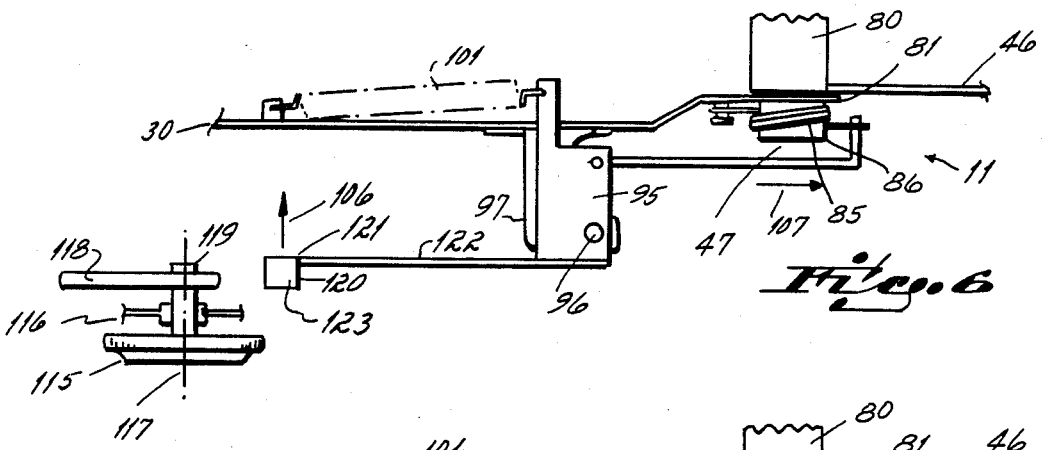
FIGS. 6 through 9 are fragmentary views similar to FIG. 4 but illustrating various alternate latch release means.

The second embodiment of the friction latch is shown in FIG. 6. That second embodiment includes a control handle in the form of a knob 115 pivotally mounted to the chair's frame 116 on horizontal axis 117. The knob 115 is fixed to an actuator 118 on spindle 119 that is journalled to the frame 116, the actuator being positioned to cooperate with a cam lobe 120 fixed to free end 121 of lever arm 122. The lever arm 122 is fixed to a pivot plate 95 which, in turn, is connected by control rod 98 with the torsion spring 85 as previously explained. In use, rotation of knob 115 in a clockwise direction causes the actuator 118 to contact cam surface 123 of cam lobe 120 which, in turn, pivots the lever arm 122 on vertical axis 96 in an inward direction toward the chair as shown by arrow 106. This causes the control rod 98 to move in the direction of arrow 107 which, in turn, releases the torsion spring 85 from latched relation with the drum 86 as previously explained. Release of the knob 115 allows control spring 101 to cooperate with the torsion spring 85 for returning the helical torsion spring to friction fit relation with the drum 86.

Figure 7:
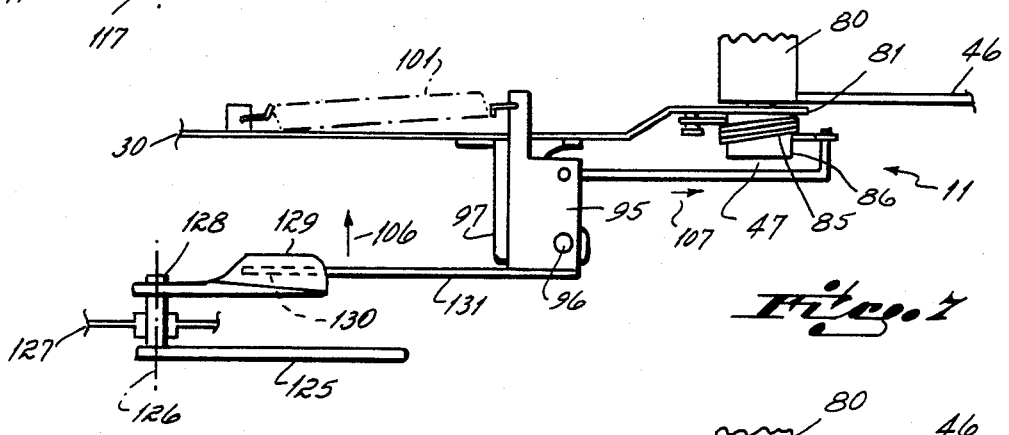

A third embodiment of the friction latch is shown in FIG. 7. In this embodiment, a bar handle 125 is eccentrically mounted on horizontal pivot axis 126 to the chair's frame 127. The handle 125 is fixed to one end of a spindle 128 journalled in the frame 127, and the other end of that spindle is connected to a cam lobe 129 adapted to cooperate with the free end 130 of lever arm 131. In this control mechanism embodiment, and when the eccentric handle 125 is pivoted in a clockwise direction, the cam lobe 129 moves the handle linkage's lever 131 inwardly toward the chair as shown by arrow 106 which, in turn, releases the torsion spring 85 from friction fit relation with the drum 86. When the eccentric handle 125 is released by the chair's user, the torsion spring 85 reassumes its friction fit latched relation with the drum 86 because the handle linkage's control spring 101 returns the handle 125 to the latch position.

Figure 8:
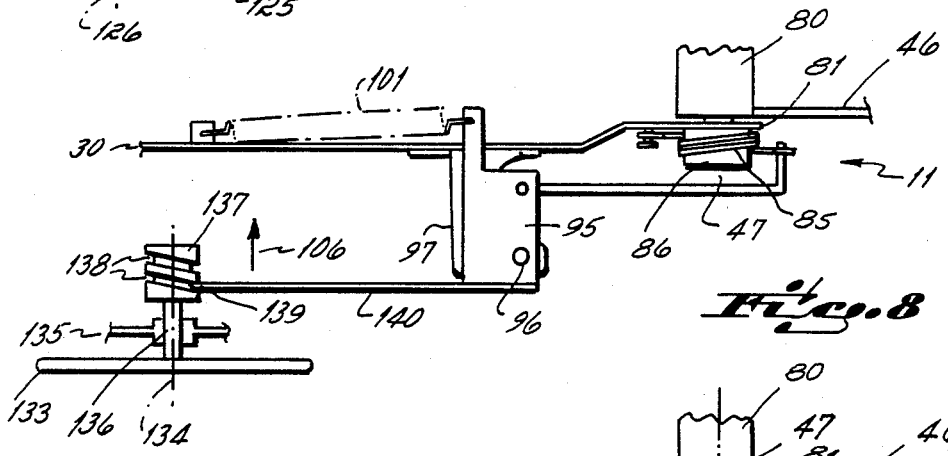

A fourth embodiment of the friction latch is shown in FIG. 8. In this embodiment, which also incorporates a handle linkage, a bar handle 133 is concentrically connected on axis 134 to the chair frame 135. The bar handle 133 is connected with one end of a spindle 136 which is journalled to the chair's frame 135, and the other end of the spindle carries a screw 137. The screw's threads 138 are positioned to interfit with the free end 139 of the handle linkage's lever arm 140. Accordingly, and when the bar handle 133 is rotated, the lever arm 140 is moved inwardly toward the chair as shown by arrow 106 against the bias of the handle linkage's spring 101 which, in turn, releases the torsion spring from the drum 86. When the bar handle 133 is released by the chair's occupant, the control spring 101 causes the lever arm 140 to return the bar handle to the latched position.

Figure 9:
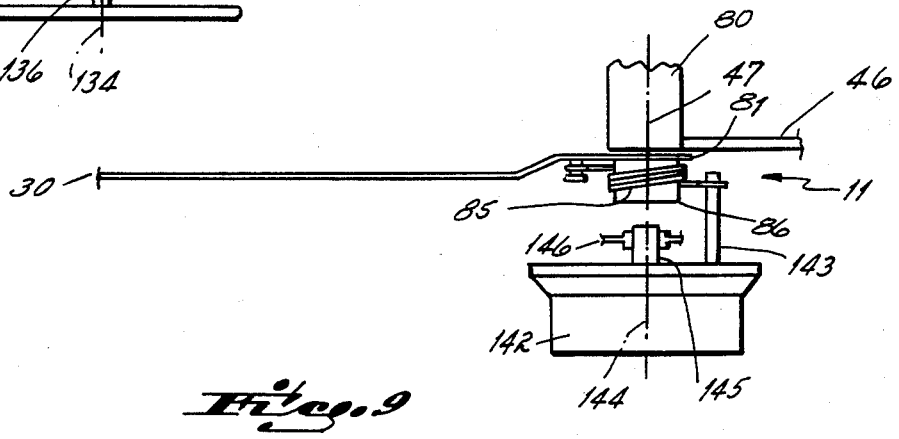

A fifth embodiment of the friction latch is shown in FIG. 9. In this embodiment, the control knob 142 is directly connected to torsion spring 85 by a pin 143 eccentrically mounted relative to the rotation axis 144 of the knob. The knob 142 is fixed to spindle 145 which is journalled to the chair's frame 146. The eccentric pin 143 is directly connected to the free end 91 of the torsion spring. Accordingly, slight rotation of the knob 142 in the clockwise direction causes the pin 143 to draw the torsion spring's free end 91 in the unlatched direction 108, thereby releasing the torsion spring 85 from tight frictional fit with the drum 86. When the knob 142 is released by the chair's occupant, it is the torsion spring 85 itself which returns the knob to the latch position since the knob is directly connected to that torsion spring, and since the torsion spring is normally biased in wrap-up direction 105 relative to drum 86. Note, therefore, that this fifth embodiment of the friction latch eliminates the need for a control handle linkage 94, and eliminates the need for the control handle's return spring 101. In this fifth embodiment, the knob's axis 144 is coaxial with the axis 47 of the drum 86 and helical torsion spring 85, whereas in the second, third and fourth alternative embodiments, the handles' axes 117, 126, 134 are offset from the axis of the drum and helical torsion spring, although in all embodiments, the handles' axes 117, 126, 134, 144 are generally horizontal relative to ground.

Having described in detail the preferred embodiment of my invention, what I desire to claim and protect by Letters Patent is:

1. A footrest assembly for a chair, said footrest assembly comprising a footrest mechanism for opening and closing a foot rest between full extend and full retract positions, said footrest mechanism being connectable to said chair, a friction latch connected with said footrest mechanism, said friction latch being manually movable by a chair's occupant between latch and release positions when the occupant is seated in said chair, said friction latch functioning to permit said footrest to be restrained in any position desired by the chair's occupant between said full extend and full retract positions and, said friction latch functioning to prevent closing movement of said footrest from any extend position back toward said full retract position in response to a minor force exerted against said footrest as created by the legs of the chair's occupant when those legs are resting on said footrest comfortably while the occupant is sitting in the chair, but said friction latch also functioning to permit closing movement of said footrest from any extend position back toward said full retract position in response to a major closing force exerted against said footrest as created by the legs of the chair's occupant when those legs are drawn thereagainst while the occupant is sitting in the chair, that major closing force imparted by the legs of the chair's occupant to said footrest being substantially greater than the minor closing force imparted to said footrest when the legs of the chair's occupant are simply resting thereon with no leg effort being made to close the footrest, and a footrest extension motor connected with said footrest mechanism, said motor functioning to open said footrest toward said full extend position from said full retract position, as well as from any partial extend position, when said friction latch is in said release position, said motor providing an opening force less than that of said major closing force.

2. A footrest assembly as set forth in claim 1, said friction latch comprising a torsion spring and a drum coaxially positioned relative one to the other, said torsion spring gripping said drum in a tight friction fit to prevent relative movement between said torsion spring and said drum in order to establish said latch's latch position, and said torsion spring releasing said drum in order to establish said latch's release position, release of said drum from said torsion spring permitting relative movement therebetween for allowing said footrest to open from a retract position to an extend position.

3. A footrest assembly as set forth in claim 1, said leg rest mechanism comprising a scissors style linkage, and said footrest extension motor comprising a spring motor.

4. A footrest assembly as set forth in claim 1, said friction latch comprising a first surface and a second surface, said surfaces being pressed together in relatively tight friction relationship one with the other when said friction latch is in said latch position, and said surfaces not being pressed together in relatively tight friction relationship when said friction latch is in said release position.

5. A footrest assembly as set forth in claim 4, said assembly comprising a latch spring normally biasing said first and second surfaces into said latch position, said latch spring being of sufficient strength to maintain said first and second surfaces in latch position in response to said minor closing force, but not being of sufficient strength to maintain said first and second surfaces in latch position in response to said major closing force.

6. A footrest assembly as set forth in claim 5, said friction latch comprising a torsion spring and a drum coaxially positioned relative one to the other, said torsion spring functioning as said first surface and as said latch spring, and said drum functioning as said second surface, said torsion spring gripping said drum in a tight friction fit to prevent relative movement between said torsion spring and said drum in order to establish said latch's latch position, and said torsion spring releasing said drum in order to establish said latch's release position, release of said drum from said torsion spring permitting relative movement therebetween for allowing said footrest to open from a retract position to an extend position.

7. A footrest assembly as set forth in claim 6, said footrest mechanism comprising a control link pivotally connectable to said chair, said drum being coaxially oriented relative to said pivot point connection of said control link with said chair.

8. A footrest assembly as set forth in claim 6, at least one end of said torsion spring being connected to said chair for immobilizing said one end relative to the other end of said torsion spring.

9. A footrest assembly as set forth in claim 6, said assembly comprising a control handle connected to said torsion spring, said control handle being manually operable by the chair's occupant to move said torsion spring from said latch position to said release position when desired by the chair's occupant.

10. A footrest assembly as set forth in claim 1, said assembly comprising a control handle connected to said friction latch, said control handle being manually operable to move said friction latch from said latch position to said release position when desired by the chair's occupant.

11. A footrest assembly for a chair as set forth in claim 10, said handle being normally biased into a position at which said friction latch is in said latch position.

12. A footrest assembly as set forth in claim 10, said assembly comprising a handle spring connected with said manually operable handle, said handle spring functioning to normally bias said handle into a position at which said friction latch is in said latch position.

13. A footrest assembly as set forth in claim 10, said handle being manually pivotable on one of a generally horizontal axis and a generally vertical axis, said handle being pivotable between latch and release positions that correspond to said friction latch's latch and release positions.

14. A footrest assembly as set forth in claim 13, said assembly comprising a handle linkage connecting said handle and said latch spring.

15. A footrest assembly as set forth in claim 2, said assembly comprising a control handle connected to said torsion spring, said control handle being manually operable to move said torsion spring from said latch position to said release position when desired by the chair's occupant, and a handle linkage connecting said handle and said torsion spring.

16. A footrest assembly as set forth in claim 15, said assembly comprising a handle spring connected with said control handle, said handle spring normally biasing said handle to said handle's latch position.

17. A footrest assembly as set forth in claim 15, said handle and said handle linkage being structured so that a generally horizontal force on said handle in an inward direction toward said chair from exteriorly of said chair functions to translate said friction latch from said latch position to said release position.

18. A leg rest assembly as set forth in claim 15, said handle and said handle linkage being structured so that a rotational force exerted on said handle functions to translate said friction latch from said latch position to said release position.

19. A chair comprising a seat, a footrest mechanism connected to said seat for opening and closing a footrest between full extend and full retract positions relative to said seat; said footrest mechanism being connectable to said chair, a friction latch connected with said footrest mechanism, said friction latch being manually movable by a chair's occupant between latch and release positions when the occupant is seated in said chair, said friction latch functioning to permit said footrest to be restrained in any position desired by the chair's occupant between said full extend and full retract positions, and said friction latch functioning to prevent closing movement of said footrest from any extend position back toward said full retract position in response to a minor force exerted against said footrest as created by the legs of the chair's occupant when those legs are resting on said footrest comfortably while the occupant is sitting in the chair, but said friction latch also functioning to permit closing movement of said footrest from any extend position back toward said full retract position in response to a major closing force exerted against said footrest as created by the legs of the chair's occupant when those legs are drawn thereagainst while the occupant is sitting in the chair, that major closing force imparted by the legs of the chair's occupant to said footrest being substantially greater than the minor closing force imparted to said footrest when the legs of the chair's occupant are simply resting thereon with no leg effort being made to close the footrest, and a footrest extension motor connected with said footrest mechanism, said motor functioning to open said footrest toward said full extend position from said full retract position, as well as from any partial extend position, when said friction latch is in said release position, said motor providing an opening force less than that of said major closing force.

20. A chair as set forth in claim 19, said friction latch comprising a first surface and a second surface, said surfaces being pressed together in relatively tight friction relationship one with the other when said friction latch is in said latch position, and said surfaces not being pressed together in relatively tight friction relationship when said friction latch is in said release position, and a latch spring normally biasing said first and second surfaces into said latch position, said latch spring being of sufficient strength to maintain said first and second surfaces in latch position in response to said minor closing force, but not being of sufficient strength to maintain said first and second surfaces in latch position in response to said major closing force.

21. A chair as set forth in claim 20, said friction latch comprising a torsion spring and a drum coaxially positioned relative one to the other, said torsion spring functioning as said first surface and as said latch spring, and said drum functioning as said second surface, said torsion spring gripping said drum in a tight friction fit to prevent relative movement between said torsion spring and said drum in order to establish said latch's latch position, and said torsion spring releasing said drum in order to establish said latch's release position, release of said drum from said torsion spring permitting relative movement therebetween for allowing said footrest to open from a retract position to an extend position.

22. A chair as set forth in claim 21, at least one end of said torsion spring being connected to said chair seat for immobilizing said one end relative to the other end of said torsion spring, and a control handle connected to the other end of said torsion spring, said control handle being manually operable to move said torsion spring from said latch position to said release position when desired by the chair's occupant.

* * * * *